US006334663B1

(12) United States Patent
Lee

(10) Patent No.: US 6,334,663 B1
(45) **Date of Patent: *Jan. 1, 2002**

(54) SERVICE STATION DEVICE FOR INK-JET PRINTER

(75) Inventor: Yong-Duk Lee, Kyungki-do (KR)

(73) Assignee: SamSung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/829,133

(22) Filed: Mar. 28, 1997

(30) Foreign Application Priority Data

Mar. 28, 1996 (KR) ..... 96-6251
Mar. 17, 1997 (KR) ..... 97-4873

(51) Int. Cl.[7] ..... B41J 2/165
(52) U.S. Cl. ..... 347/29; 347/33
(58) Field of Search ..... 347/24, 29, 30, 347/32, 33; 400/663

(56) References Cited

U.S. PATENT DOCUMENTS 4,177,471 A * 12/1979 Mitchell ..... 347/37
4,577,200 A * 3/1986 Rix et al. ..... 347/49
5,260,724 A * 11/1993 Tomii et al. ..... 347/32
5,325,111 A * 6/1994 Dietl ..... 347/30
5,394,178 A * 2/1995 Grange ..... 347/32
5,426,456 A 6/1995 Kuelzer et al.
5,448,270 A 9/1995 Osborne
5,471,230 A 11/1995 Saito et al.
5,517,219 A * 5/1996 Uchida ..... 347/24
5,612,721 A * 3/1997 Ishize ..... 347/33
5,644,345 A * 7/1997 Tonilio ..... 347/32

FOREIGN PATENT DOCUMENTS

JP 363011347 A * 1/1988 ..... 347/30
JP 405330057 A * 12/1993 ..... 347/30

OTHER PUBLICATIONS

Merriam Webster's Collegiate Dictionary, 10th Ed., 1993, p. 1106.*

* cited by examiner

*Primary Examiner*—John Barlow
*Assistant Examiner*—Michael S Brooke
(74) *Attorney, Agent, or Firm*—Robert E. Bushnell, Esq.

(57) ABSTRACT

This service station device has a wiper for cleaning a nozzle of a head, and a cap for capping and sealing for the nozzle, the wiper and the cap are provided at a moving member moved within the housing, while the head is moved to a service area from a printing area by a carriage. When the carriage is in a position for capping and sealing the nozzle by the cap, the carriage is locked at the capping and sealing position by a locking member service station device, so that the nozzle is prevented it from releasing from the capping and sealing thereof. Also, the capping and sealing of the nozzle can be maintained for a certain distance when the carriage is moved from the printing area to the service area, or from the service area to the printing area.

17 Claims, 6 Drawing Sheets

SERVICE STATION DEVICE FOR INK-JET PRINTER

CLAIM OF PRIORITY

This application makes reference to, incorporates the same herein, and claims all benefits accruing under 35 U.S.C. §119 arising from an application for Service Station Device For Ink-Jet Printer earlier filed in the Korean Industrial Property Office on Mar. 28, 1996 and there duly assigned Ser. No. 6251/1996.

FIELD OF THE INVENTION

The present invention relates to a service station device for an ink-jet printer which serves to clean and seal a nozzle of the printer's head. More particularly, it relates to a service station device for an ink-jet printer which can effectively clean and seal a nozzle of the printer head with a rotary motion of a cap and has the more improved capping function by restricting movement of a carriage for carrying the printer head during a sleep mode of the printer.

DISCUSSION OF RELATED ART

There are many patents that discuss sealing and capping means for the nozzle of an ink jet printer. For example, U.S. Pat. No. 5,471,230 for a Capping Means and Ink Jet Recording Apparatus Using The Same to Saito et al., U.S. Pat. No. 5,448,270 for an Ink-Jet Printhead Cap Having Suspended Lip to Osborne and U.S. Pat. No. 5,426,456 for a Suction and Covering Device For Suctioning Ink From Ink Print Heads of an Ink Jet Print Unit and For Sealing The Ink Jet Print Heads to Kuelzer et al. each discuss a means for capping a nozzle for an ink-jet printer to prevent leakage of ink. However, what is missing is a way for positioning the cap exactly to fit over the nozzle of an ink jet printer to prevent the unwanted leakage of ink when the nozzle is supposed to be capped. Also, what is not discussed is a mechanism for preventing the inadvertent detachment of the cap from the nozzle of the ink-jet printer if the ink jet printer is inadvertently bumped or moved while the printer is not printing. In such a scenario, is desirable to have the cap remain attached to the nozzle so as to prevent the leakage of ink.

SUMMARY OF THE INVENTION

Accordingly, the present invention is directed to a device that substantially obviates one or more of the problems, limitations and disadvantages of the related art.

It is an objective to provide a service station device for an ink-jet printer which can clean a nozzle of a printer head and exactly seal the nozzle with its cap to prevent loss of ink and problems of the nozzle.

The above and other objects are achieved, according to the invention, by the provision of a service station device for an ink-jet printer, the service station device including: a housing secured in a service area of a printer and having first guide slots and second guide slots formed in both side walls thereof, the guide slots being disposed in a line and said second guide slots each having an upper straight portion and a lower inclined portion; a moving member disposed in said housing to be moved to a position for capping and sealing an ink nozzle by a carriage and forced toward a printing area by a spring secured on a bottom of the housing, and having front and rear guide pins guided along the first and second guide slots, respectively; a wiper member having a wiper for cleaning the nozzle and being pivotally mounted to the housing, the wiper member being in a position for cleaning the nozzle when the rear guide pins are in a lower end of the second guide slots; and a capping and sealing member having a cap for capping and sealing the nozzle, the cap capping and sealing the nozzle when the rear guide pins begin to move to the upper straight portion of the second guide slots from the lower inclined portion thereof.

Alternatively, the above and other objects also can be achieved according to the present invention, by the provision of a service station device for an ink-jet printer, the service station device including: a housing secured in a service area of a printer and having first guide slots and second guide slots formed in both side walls thereof, the guide slots being disposed in a line and the second guide slots each having an upper straight and a lower inclined portion; a moving member disposed in the housing to be moved a position for capping and sealing an ink nozzle by a carriage and forced toward a printing area by a spring secured on a bottom of the housing, and having front and rear guide pins guided along the first the said second guide slots, respectively; a wiper member having a wiper for cleaning the nozzle and being pivotally mounted to the housing, the wiper member being pivoted to a position for cleaning the nozzle by the moving member forced toward the printing area by the spring; and a capping and sealing member having a cap for capping and sealing the nozzle, the cap capping and sealing the nozzle when the rear guide pins begin to move to the upper straight portion of the second guide slots from the lower inclined portion thereof.

The service station device according to the present invention may further include a locking member provided on a frame of the printer and forced toward the carriage by a resilient member, to hold the nozzle in the capping and sealing position.

The wiper member includes a wiper body formed by a pair of plates, and pin members inserted pivotally into holes formed on both side walls of the housing; the wiper is positioned adjacent to a free end of the wiper body.

The capping and sealing member includes a biasing member biasing the cap upwardly. The cap includes a shaft inserted into a hole formed in the moving member and a catch for preventing the cap from separating from the hole, and the biasing member is disposed around the shaft.

The cap has preferably a height such that the cap is slightly pressed by the nozzle when the nozzle is sealed in the capping and sealing position by the cap.

The moving member includes a touch guide uprightly provided on a front portion thereof, and a spring barb positioned below the t ouch guide to extend downwardly, the touch guide being forced to the capping and sealing position by the carriage moving to the capping and sealing position, and the spring barb is connected with the spring for forcing the moving member to a printing position.

The housing has a stopper provided at rear end there of for supporting the wiper member when the moving member is moved the capping and sealing position.

The locking member includes an elongated snap piece fixed on a frame and having a rounded projection formed at an end thereof, and a resilient member for pulling the elongated snap piece toward a side of the carriage, the rounded projection being engaged with a rounded recess formed at the side of the carriage. A resilient force of the resilient member is smaller than a moving force of the carriage.

It is to be understood that both the foregoing general description and the following detailed description are exemplary and explanatory, and are intended to provide further explanation of the invention as claimed.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT

Figure 1:
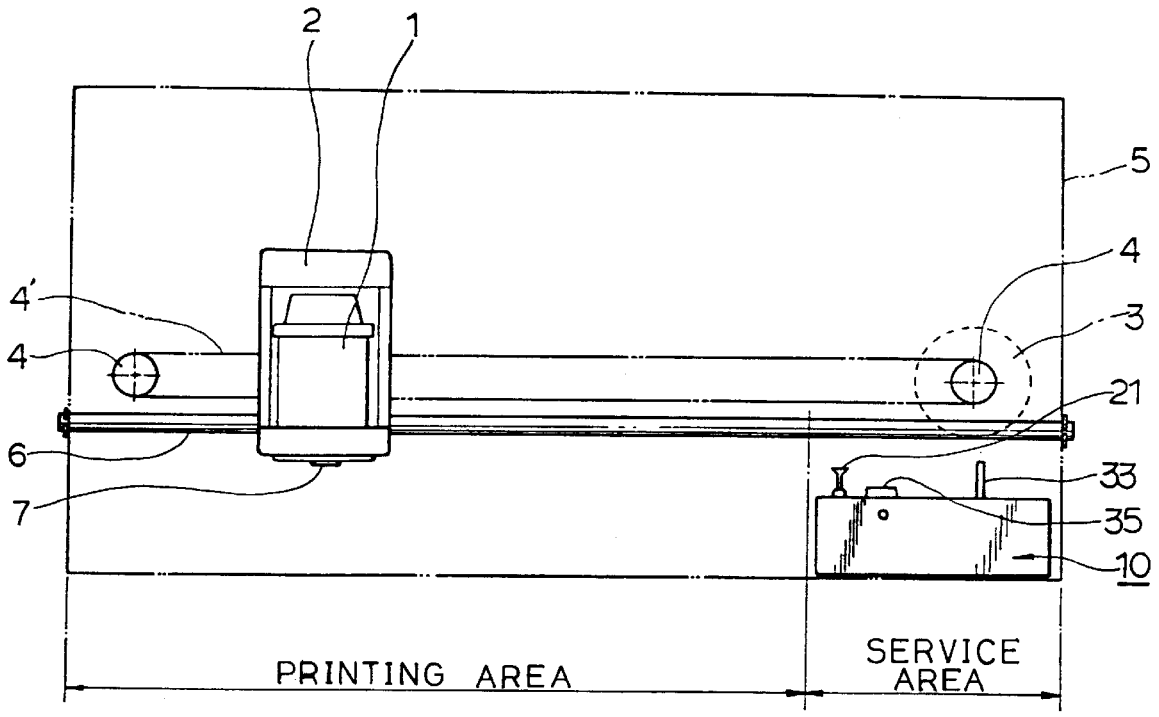
FIG. 1 schematically depicts a conventional ink-jet printer with printing and service zones.

Turning to FIG. 1, in a conventional ink-jet printer a carriage 2, on which a head 1 is mounted, the head 1 is slid right and left by a timing pulley 4 and a belt 4' driven by a forwarding/reversing motor 3. The carriage 2 is moved along a guide shaft 6 fixed on a main body frame 5, in a straight line.

Therefore, the head 1 is moved along a guide shaft 6 by the carriage 2 and performs a printing by injecting ink on paper through a nozzle 7 provided on a bottom surface thereof. This printing operation is carried out in a printing area of the printer while the paper is passing through the printer. Adjacent to the printing area, there is disposed a service area in which the nozzle 7 is cleaned and sealed to prevent loss of ink. The cleaning and the capping of the nozzle 7 are carried out by a service station device. The service station device includes a means for cleaning the nozzle 7 according to a cleaning signal of the controller, and a means for capping and sealing nozzle 7 to prevent loss of ink.

Figure 2:
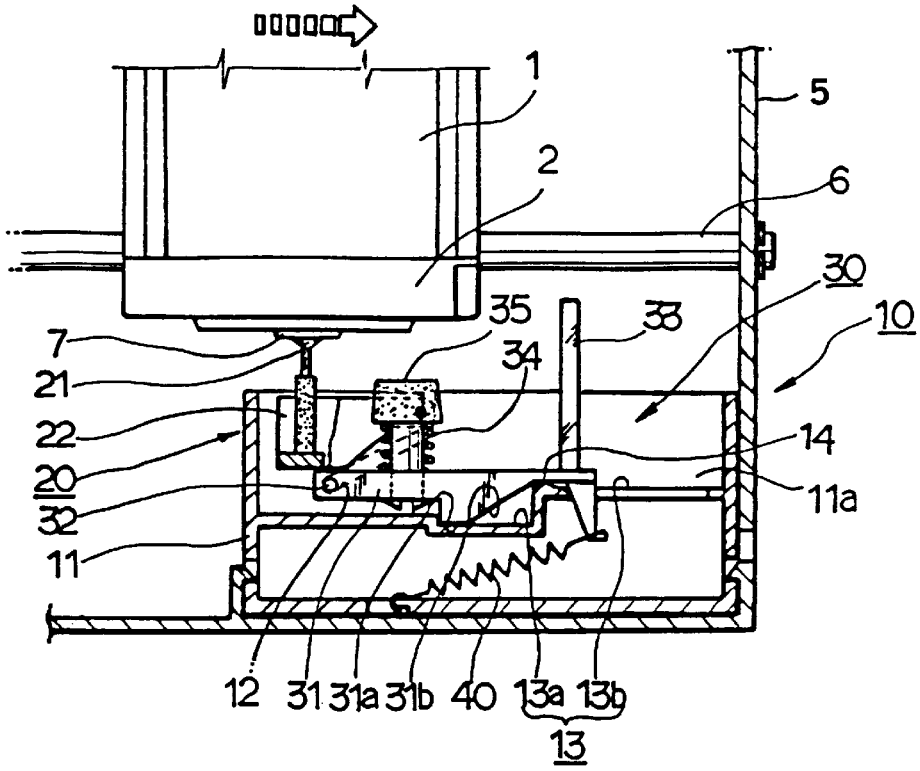
FIG. 2 is a longitudinally-sectional view of a conventional service station device for an ink-jet printer.
Figure 3:
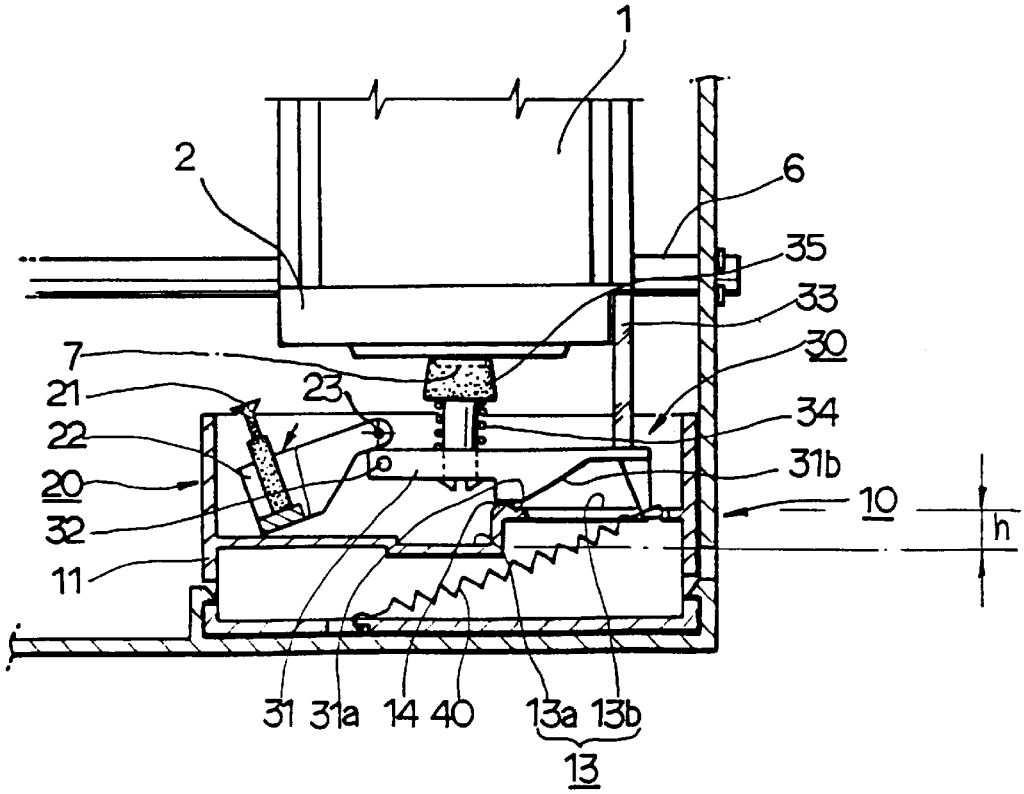
FIG. 3 is a sectional view for describing the operating mechanism of the conventional service station device.

FIG. 2 is a conventional service station device 10. This service statio n device 10 has a housing 11 fixed on a bottom surface of the main body frame 5. The housing 11 is rectangular shaped, and has a rectangular space 11*a* in its interior, in which a cleaner 20 and a capping assembly 30 are installed. The cleaner 20 includes a wiper body 22 on which a wiper 21 made of rubber is fixedly mounted, and the wiper body 22 is pivoted about a point 23 (FIG. 3). The capping assembly 30 includes a moving member 31, and the guide projections 32 are moved along guide slots 12 formed in both side walls of the housing 11 moved in the space 11*a*, and guide projections 32 are formed on both sides of the moving member 31. A touch guide 33 is uprightly provided on the moving member 31, opposite to the guide projection 32, so that moving member 31 is pushed to the s service area by the carriage 2 when the carriage 2 is moved to the service area. In addition, a cap 35 for capping and sealing the nozzle 7 is installed on the moving member 31, and the cap 35 is biased upwardly by spring force of a spring 34.

Each of the guide slots 12 has a same shape as a sliding face 13 formed inside of the housing 11, and a straight lower surface 31*a* of the moving member 31 contacts with the sliding face 13, so that the straight lower surface 31*a* can move along a sliding face 13 when the moving member 31 is moved. The moving member 31 has a straight lower surface 31*a* and an inclined lower surface 31*b*, and the straight lower surface 31*a* is substantially shorter than the inclined lower surface 31*b*.

The sliding face 13 has a lower sliding area 13*a* positioned at a central portion of the housing 11 and an upper sliding area 13*b* positioned at one side of the housing 11. An inner edge 14 of the upper sliding area 13*b* is rounded, which is a starting point of the upper sliding area 13*b*. The straight lower surface 31*a* is positioned on the lower sliding area 13*a* and an upper portion of the inclined lower surface 31*b* is contacted with the inner edge 14 of the upper sliding area 13*b* when the carriage 2 is in the printing area, as shown in FIG. 2.

The moving member 31 positioned in the space 11*a* is biased toward the printing area by a spring 40, of which both ends are secured to a front-lower portion of the moving member 31 and the bottom of the housing 11, respectively. The wiper body 22 is supported by the moving member 31 to be maintained horizontally.

The carriage 2 is moved from the printing area and to the service area for cleaning and/or capping and sealing the nozzle 7 of the printer head 1 when the printer is turned off or when the nozzle 7 is periodically cleaned. The nozzle 7 is contacted with a wiping surface of the wiper 21 to thereby remove a residuary ink on the nozzle 7 while the nozzle 7 is passed through the wiper 21, as shown in FIG. 2.

After the nozzle 7 is cleaned by the wiper 21, the moving member 31 is moved to a position shown in FIG. 3 by the carriage 2 and the wiper body 22 is pivoted about the point 23 downwardly, as the touch guide 33 provided uprightly on the moving member 31 is pushed by the carriage 2. At this time, the moving member 31 is rising upwardly since the inclined lower surface 31*b* is slid upon the inner edge 14 and the guide projections 32 are guided along the guide slots 12.

When the moving member 31 is stopped, the lower surface 31*a* is positioned on the upper sliding area 13*b*, and the nozzle 7 is sealed by the cap 35 biased upwardly by the spring 34. The cap 35 is not separated from the nozzle 7 until the carriage 2 is returned to the printing area to prevent loss of the ink. When the carriage 2 is returned to the printing area, the moving member 31 is returned to a ready position (as shown in FIG. 2) by the spring force of the spring 40.

In the conventional service station device 10, the moving member 31 has a relative larger elevation and descent distance h, and the larger the distance h becomes, the more difficult it is to exactly cap and seal the nozzle 7 with the cap 35.

Therefore, it is preferable to design the moving member having a smaller elevation and descent distance h, but this is not easy because the moving member is moved along with the carriage to seal the nozzle.

Also, during the sleep mode of the printer, because a binding force of the timing belt acts on the carriage, but this binding force is substantially small, the carriage may be released from the service area when shipping the printer to another place. The moving member may escape from the sealing position as held by the spring due to the moving of the carriage, so that the capping of the nozzle may be released. This may cause the ink on the nozzle to dry, which causes problems of the nozzle.

Reference will now be made in detail to the preferred embodiments of the present invention, examples of which are illustrated in the accompanying drawings.

FIGS. 4 to 9 depict a service station device 100 for an ink-jet printer in accordance with the present invention.

Figure 6:
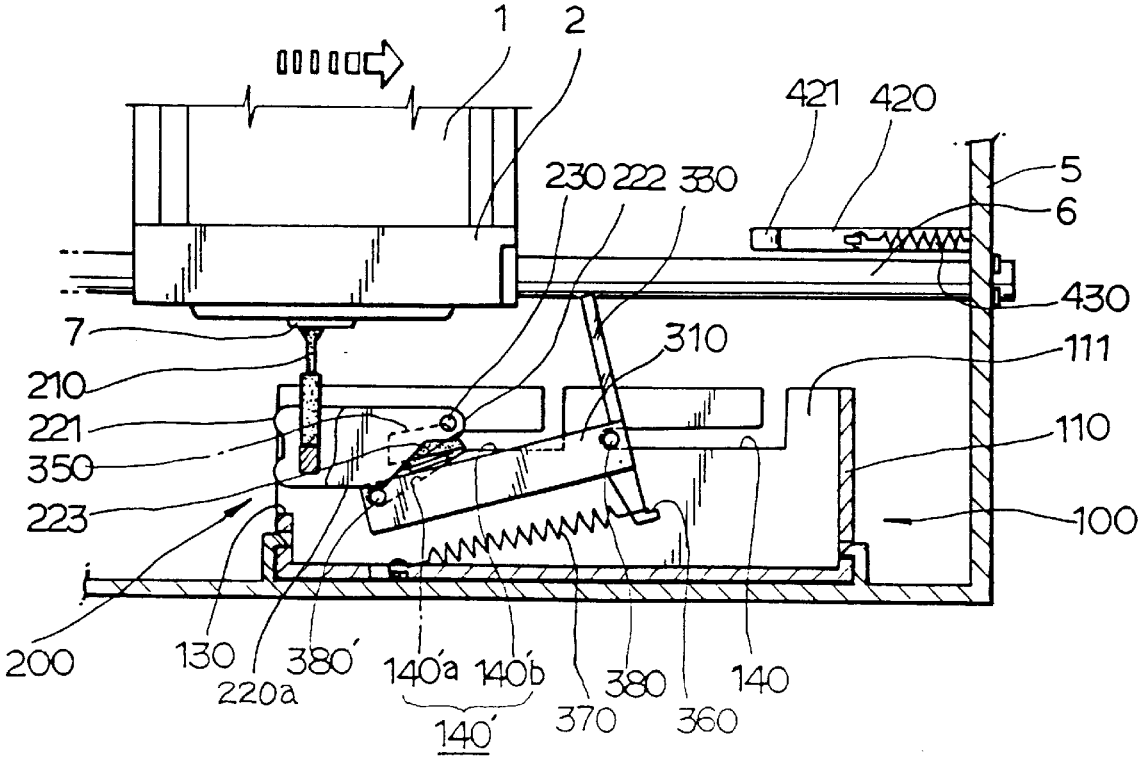
FIG. 6 is a longitudinally-sectional view of a service station device for an ink-jet printer in accordance with the present invention.

In the service station device 100 a housing 110 is fixedly mounted in a service area of a frame 5 of the printer main body (see FIG. 6). A cleaner 200 has a wiper 210, which is made from rubber, for cleaning a nozzle 7 of a printer head 1 which is mounted to a carriage 2 and moved between the service area and a printing area by the carriage 2, and is installed pivotally to both side walls of the housing 110. A capping assembly 300 has a cap 350 for sealing the nozzle 7 of the printer head 1 and is installed in first guide slots 140 and second guide slots 140' formed in both side walls of the housing 100 such that the capping assembly 300 is moved along the guide slots 140 and 140'.

Preferably, a locking member 400 may be provided in the service station device 100 for locking the carriage 2 to prevent the sealing of the nozzle 7 from releasing when the nozzle 7 is capped and sealed by the cap 350. The locking member 400 is mounted to the frame 5 of the printer main body.

Figure 4:
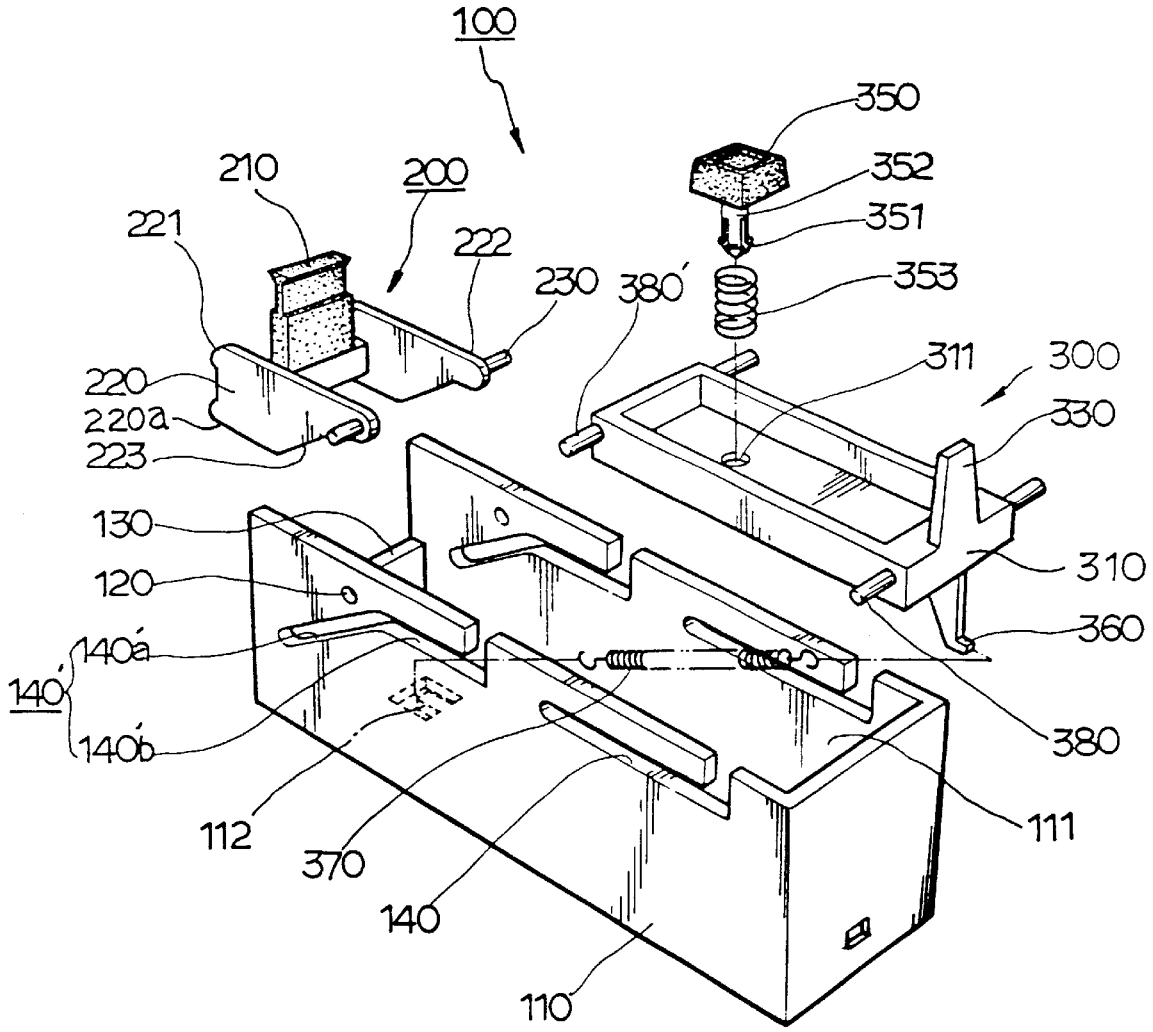
FIG. 4 is an exploded perspective view of a service station device for an ink-jet printer in accordance with the present invention.

The housing 110 is formed by injection-molding materials such as a plastic resin in rectangular form, and has a space 111 formed therein for receiving the cleaner 200 and the capping assembly 300. The first guide slots 140 are disposed adjacent one side of the housing 110 and a portion of the second guide slots 140' are disposed in a line with the first guide slots 140 adjacent the other side of the housing 110, as shown in FIG. 4. The holes 120 are disposed adjacent to an inclined portion 140'*a* of the second guide slots 140', respectively.

The cleaner 200 has a wiper body 220 formed by a pair of plates 221 and disposed within the space 111. The wiper 210 is positioned uprightly between the plates 221, a pair of pin members 230 are disposed at a pivot end 222 of the wiper body 220, respectively, and the pin members 230 extend laterally from the wiper body 220 and are pivotally inserted into the holes 120. The wiper body 220 is disposed at rear end of the housing 110 and has a slant guide surface 223 below the pivot end 222, as shown in FIG. 4. When the cleaner 200 is positioned horizontally, a lower end of the slant guide surfaces 223 is disposed above a lower end of the inclined portion 140'*a* of the second guide slots 140', as shown in FIG. 6.

The capping assembly 300 has a rectangular moving member 310 having two pairs of guide pins 380 and 380' extending laterally at both sides of front and rear portions thereof, respectively. The pairs of guide pins 380 and 380' are inserted into the first guide slots 140 and the second guide slots 140' of the housing 110, respectively. The moving member 310 also has a hole 311 into which the cap 350 is inserted, and a touch guide 330 is uprightly provided on a front portion of the moving member 310, and a spring barb 360 is positioned below the touch guide 330 to extend downwardly.

The cap 350 is made from rubber and has a shaft 352 for connecting the cap 350 to the moving member 310, and a catch 351 which is forced into the hole 311 on the moving member 310 and prevents the cap 350 from separating from the hole 311. When the cap 350 is installed to the moving member 310, the cap 350 is biased upwardly by a biasing member 353 which is disposed around the shaft 352. The cap 350 has a height such that the cap 350 is slightly pressed by the nozzle 7 when the nozzle 7 is sealed by the cap 350. Therefore, the cap 350 can surely seal the nozzle 7 when the nozzle 7 is in a capping position.

The touch guide 330 is pushed toward outside of the housing 110 by the carriage 1 moved from the printing area to the service area. The spring barb 360 is secured with one end of a spring 370 for pulling the moving member 310 to the printing area, of which other end is secured to a spring fixing piece 112 which is provided on a bottom of the housing 100. Therefore, the moving member 310 is forced to the printing area by the spring 370 when the carriage 2 is in the printing area, as shown in FIG. 6.

Figure 8:
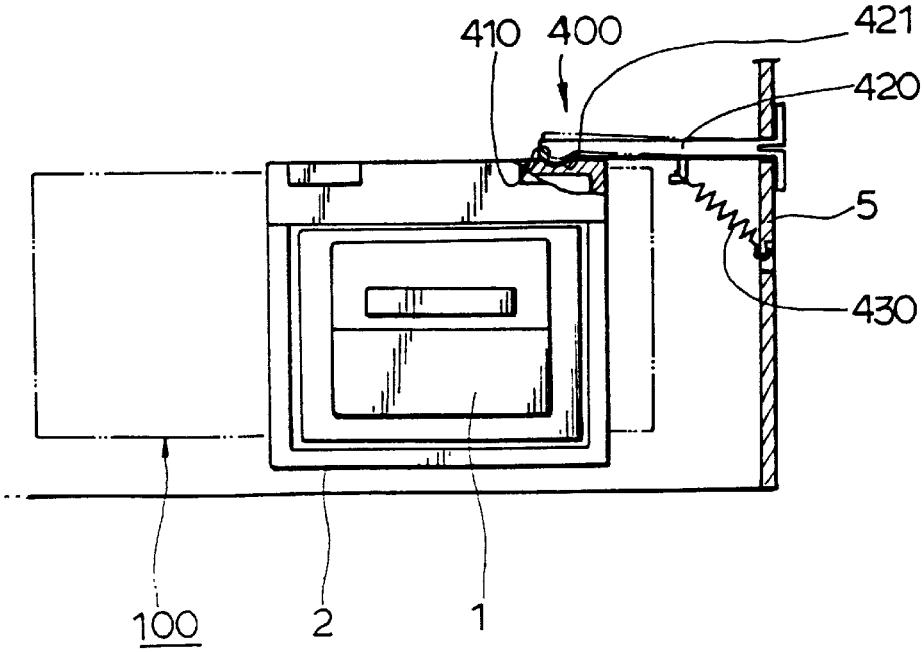
FIG. 8 is a sectional view as taken along line A–A' of FIG. 7.
Figure 9:
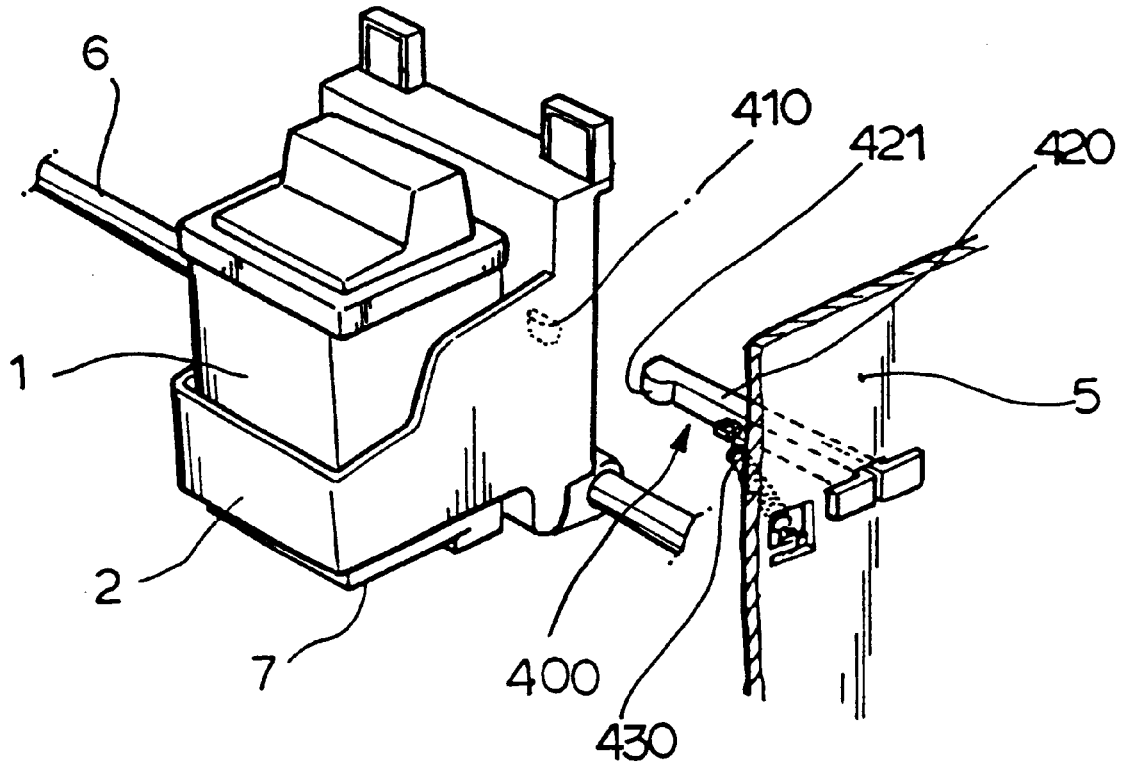
FIG. 9 is a perspective view of a carriage locking member of FIG. 8.

The locking member 400 serves to prevent the movement of the carriage 2 when the nozzle 7 is in the capping position As shown in FIG. 8, the locking member 400 includes an elongated snap piece 420 having a rounded projection 421 formed at an end thereof and movable laterally, and a resilient member 430 for pulling the elongated snap piece 420 toward the side of the carriage 2. A resilient force of the resilient member 430 is smaller than the moving force of the carriage 2.

The elongated snap piece 420 is fixed to the frame 5 of the service area to which the carriage 2 is moved, and both ends of the resilient member 430 are respectively secured to a middle portion of the elongated snap piece 420 and the frame 5.

The locking projection 421 is engaged with a rounded recess 410 formed at the side of the carriage 2 by the resilient member 430 when the carriage 2 is in the service area due to turning off the printer, or for cleaning the nozzle 7 periodically, as shown in FIG. 8. The engagement between the rounded projection 421 and the rounded recess 410 by the resilient member 430 is released when the carriage 2 is moved to the printing area from the service area since the resilient force of the resilient member 430 is smaller than the moving force of the carriage 2.

The service station device according to the present invention operates as follows:

The carriage 2, on which the head 1 is mounted, is moved toward the service area from the printing area, when the printer is turned off or when it is necessary to clean the nozzle 7 periodically.

Figure 5:
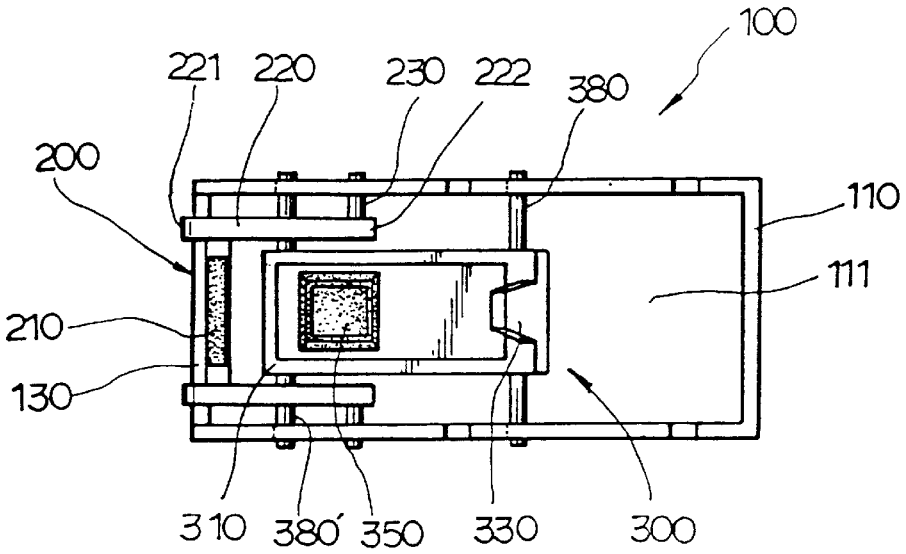
FIG. 5 is a plan view of the service station device in accordance with the present invention.

FIG. 5 shows the initial state of a service station device according to the present invention, and FIG. 6 shows that the nozzle 7 is cleaned by the wiper 210 of cleaner 200 while the carriage 2 is moved to the service area from the printing area. As shown in FIGS. 5 and 6, a lower surface 220*a* of the wiper body 220 is supported by the rear guide pins 380' of the moving member 310 which is forced to the printing area by the spring force of the spring 370, so that the wiper body 220 is disposed horizontally and the wiper 210 is disposed uprightly to contact with and to clean the nozzle 7.

Because the rear guide pins 380' of the moving member 310 are positioned at the lower end of the inclined portion 140'*a* of the second guide slots 140' and the front guide pins 380 are positioned at a rear end of the first guide slots 140, the moving member 310 is obliquely disposed by a position difference between the guide pins 380' and 380, as shown in FIG. 6. Accordingly, the touch guide 330 uprightly provided on the front portion of the moving member 310 also is obliquely disposed. At this time, the upper end of the touch guide 330 is positioned on a moving path of the carriage 2.

Figure 7:
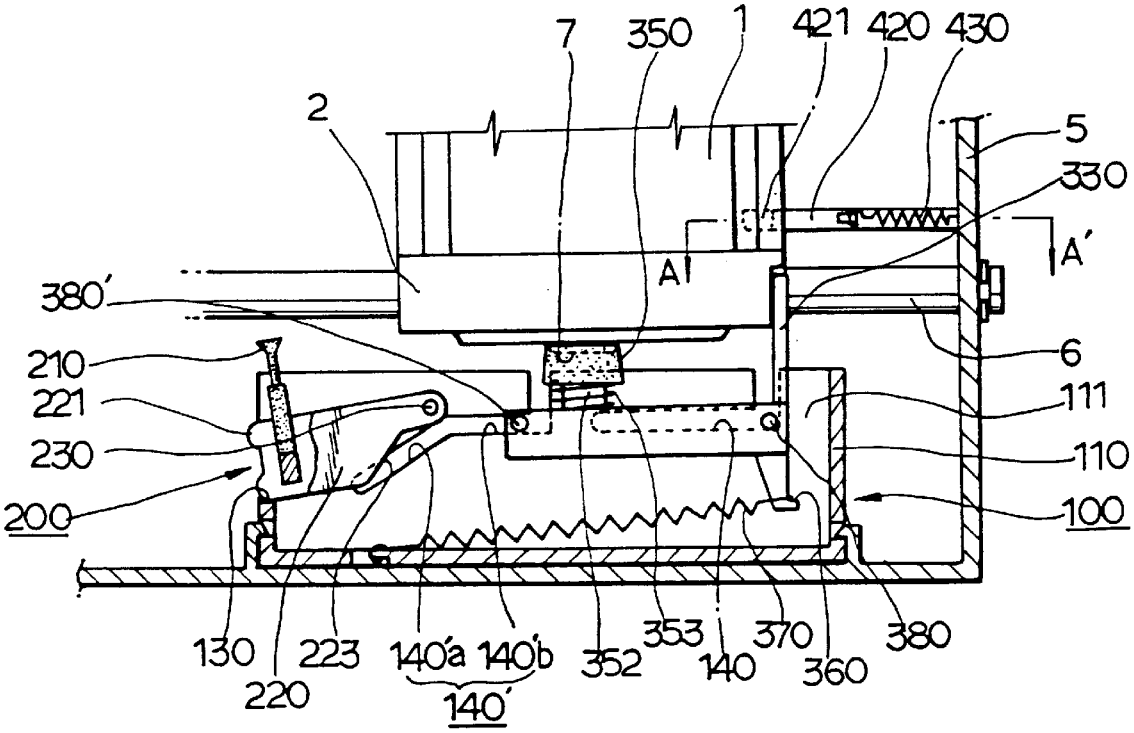
FIG. 7 is a sectional view for describing the operating mechanism of the inventive service station device.

The touch guide 330 is forced to the service area by the carriage 2 and the moving member 310 is moved to a position for sealing the nozzle 7 against the spring force of the spring 370, as shown in FIG. 7, as the carriage 2 is continuously moved to the service area after the nozzle 7 is cleaned by the wiper 210 as shown in FIG. 6.

The guide pins 380 and 380' provided at both sides of front and rear portions of the moving member 310 are moved along the first guide slots 140 and the second guide slots 140' and the nozzle 7 is sealed by the cap 350 at a point where there is finished the inclined portion 140'*a* of the second guide slots 140', while the moving member 310 is moved to the capping position of the nozzle 7. Accordingly, the moving member 310 is moved to the capping position under condition that the nozzle 7 is sealed by the cap 350 while the rear guide pins 380' are moved along a straight portion 140'*b* of the second guide slots 140'.

On the other hand, when the moving member begins to move to the capping position by the carriage 2, the wiper body 220 begins to pivot downwardly about the pins 230 by a self-weight thereof, since the rear guide pins 380', by which the lower surface 220*a* of the wiper body 220 is supported, is moved to the capping position along the inclined portion 140'*a*. The wiper body 220 is pivoted continuously and downwardly about the pins 230 until the lower surface 220*a* is supported by a stopper 130 provided at a rear side of the housing 110. Accordingly, the wiper 210 is positioned below the cleaning position when the nozzle 7 is sealed by the cap 350.

The locking member 400 is operated by contacting with a leading end of the carriage 2 when the carriage 2 is moved to the capping position. As the rounded projection 421 of the elongated snap piece 420 is contacted with the leading end of the carriage 2, the elongated snap piece 420 is slightly pivoted outwardly against the resilient member 430, and then the rounded projection 421 is received in the rounded recess 410 formed at the side of the carriage 2 by the resilient member 430 when the nozzle 7 arrives in the capping position. Therefore, the carriage 2, i.e., the nozzle 7 can be maintained in the capping position by the locking member 400 during the turnoff of the printer, or the capping and sealing of the nozzle 7, as shown in FIGS. 7 and 8. When the nozzle 7 is sealed with the cap 350 by turning off the printer, or by capping and sealing it, as shown in FIGS. 7 and 8, if the carriage 2 begins to move to the printing position, the rounded projection 421 is separated from the rounded recess 410 to release the locking of the carriage 2 by the locking member since the resilient force of the resilient member 430 is smaller than the moving force of the carriage 2, as above described.

The moving member 310 is moved to the position shown in FIG. 6 by the spring force of the spring 370. The capping of the nozzle 7 by the cap 350 is released at the point where the straight portion 140'*b* of the second guide slots 140' is finished and the inclined portion 140'*a* is begun.

The wiper body 220 is pivoted upwardly by the rear guide pins 380' and is positioned horizontally to clean the nozzle 7 when the nozzle 7 passes through the cleaning position, as the rear guide pins 380' are moved downwardly along the inclined portion 140'*a* of the second guide slots 140' and positioned at the lower end of the inclined portion 140'*a*.

The moving member has a relative small elevation and descent distance since the lower surface of the wiper body is supported by the stopper provided at the rear side of the housing. Accordingly, capping and sealing the nozzle by the cap can be easy.

Also, during the sleep mode of the printer, although the carriage may be released from the service area when shipping the printer to another place, the moving member can be prevented from escaping from the sealing position, since the carriage is locked in the capping position by means of the locking member. Also, although the moving member can move from the capping position, the nozzle is prevented from loss of sealing since the capping of the nozzle can be maintained for a certain distance as the moving member moves in the first guide slots. Accordingly, the drying of the nozzle can be prevented, avoiding problems of the nozzle.

As described above, in the service station device of the present invention, as the nozzle is not only cleaned by the wiper but also capped and sealed by the cap, in correct positions, the nozzle can carry out its function without error.

It will be apparent to those skilled in the art that various modifications and variations can be made in the service station device for an ink jet printer of the present invention without departing from the spirit or scope of the invention. Thus, it is intended that the present invention cover the modifications and variations of this invention provided they come within the scope of the appended claims and their equivalents.

What is claimed is:

1. A service station device for an ink-jet printer, said service station device comprising:

a housing including two side walls secured in a service area of an ink-jet printer, said side walls each including a first guide slot and a second guide slot, said first and second guide slots of each side wall including a portion disposed along a line and each of said second guide slots having an upper straight portion and a lower inclined portion;

a moving member disposed in said housing, said moving member moveable to a position for capping and sealing a nozzle for ink by a carriage of the ink-jet printer and having front and rear guide pins guided along said first and said second guide slots, respectively;

a spring attached to a bottom of said housing and to said moving member, said spring for biasing said moving member toward a printing area of the ink-jet printer;

a wiper member including a wiper for cleaning the nozzle and being pivotally mounted to said housing, said wiper member being in the position for cleaning the nozzle whenever the rear guide pins are in a lower end of the second guide slots; and a capping and sealing member including a cap for capping and sealing the nozzle, said cap being mounted to said moving member so as to cap the nozzle when said rear guide pins are respectively in the upper straight portion of each of said second guide slots.

2. The service station device according to claim 1, further comprising a locking member provided on a frame of the ink-jet printer and forced toward a carriage of the ink-jet printer by an elastic member, said locking member for holding the nozzle in the position for capping and sealing the nozzle.

3. The service station device according to claim 2, further comprised of the locking member including an elongated snap piece and including a rounded projection formed at an end of said elongated snap piece, and said elastic member for forcing the elongated snap piece toward a side of the carriage of the ink-jet printer, said rounded projection being engagable with a rounded recess formed at the side of the carriage.

4. The service station device according to claim 3, further comprised of an elastic force of said elastic member being smaller than a moving force of the carriage.

5. The service station device according to claim 1, further comprised of the wiper member including a wiper body formed by a pair of plates, and the wiper member including pin members inserted pivotally into holes formed in both said side walls of said housing, said wiper body having a free end and said wiper being positioned adjacent to the free end of said wiper body.

6. The service station device according to claim 1, further comprised of:

said capping and sealing member including a biasing member for biasing said cap upwardly;

said cap including a shaft inserted into a hole formed in said moving member and said shaft including a catch for preventing said cap from separating from the hole; and said biasing member being disposed around said shaft.

7. The service station device according to claim 1, further comprised of said cap being of a height such that said cap is pressed by the nozzle when the nozzle is sealed in the position for capping and sealing the nozzle by said cap.

8. The service station device according to claim 1, further comprised of the moving member including a touch guide uprightly provided on a front portion of the moving member, and a spring barb positioned below said touch guide to extend downwardly, said touch guide being forced to a position corresponding to the position for capping and sealing the nozzle by a carriage of the ink-jet printer moving to a position corresponding to the position for capping and sealing the nozzle, and said spring barb being connected with said spring for forcing said moving member to a printing position.

9. The service station device according to claim 1, further comprised of said housing including a stopper provided at a rear end of the housing for supporting said wiper member when said moving member is moved to the position for capping and sealing the nozzle.

10. A service station device for an ink-jet printer, said service station device comprising:

a housing including two side walls secured in a service area of an ink-jet printer, said side walls each including a first guide slot and a second guide slot, said first guide slot and said second guide slot of each side wall including a portion disposed along a line and each said second guide slot including an upper straight portion and a lower inclined portion;

a moving member disposed in said housing, said moving member being moveable to a position for capping and sealing a nozzle for ink by a carriage of the ink-jet printer and said moving member including front guide pins and rear guide pins for being guided along each corresponding said first guide slot and each corresponding said second guide slot in each of said side walls, respectively;

a spring attached to a bottom of said housing and to said moving member, said spring for biasing each of said rear guide pins toward a corresponding said lower inclined portion of a corresponding said second guide slot;

a wiper member including a wiper for cleaning the nozzle and being pivotally mounted to said housing, said wiper member being pivoted to a position for cleaning the nozzle by said moving member being forced toward a printing area by said spring;

a capping and sealing member including a cap for capping and sealing the nozzle, said cap being mounted to said moving member so as to cap the nozzle when each of said rear guide pins are in a corresponding said upper straight portion of a corresponding said second guide slot in each of said side walls; and a locking member provided on a frame of the ink-jet printer and forced toward a carriage of the ink-jet printer by an elastic member, said locking member for holding the nozzle in the position for capping and sealing the nozzle, said locking member including an elongated snap piece and including a projection formed at an end of said elongated snap piece, said elastic member for forcing said elongated snap piece toward a side of the carriage, and said projection for being engaged with a recess formed at the side of the carriage.

11. The service station device according to claim 10, further comprised of the wiper member including a wiper body formed by a pair of plates, and the wiper member including pin members inserted pivotally into holes formed in both said side walls of said housing, said wiper being positioned adjacent to a free end of said wiper body.

12. The service station device according to claim 10, further comprised of said capping and sealing member including a biasing member for biasing said cap upwardly, said cap including a shaft inserted into a hole formed in said moving member, and said shaft including a catch for preventing said cap from separating from the hole, said biasing member being disposed around said shaft.

13. The service station device according to claim 10, further comprised of said cap being of a height such that the cap is pressed by the nozzle when the nozzle is sealed in the position for capping and sealing the nozzle by said cap.

14. The service station device according to claim 10, further comprised of the moving member including a touch guide uprightly provided on a front portion of the moving member, and a spring barb positioned below said touch guide to extend downwardly, said touch guide being forced to a position corresponding to the position for capping and sealing the nozzle by the carriage moving to a position corresponding to the position for capping and sealing the nozzle, and said spring barb being connected with said spring for forcing said moving member to a printing position.

15. The service station device according to claim 10, further comprised of said housing including a stopper provided at a rear end of the housing for supporting said wiper member when said moving member is moved to the position for capping and sealing the nozzle.

16. The service station device according to claim 10, further comprised of said elongated snap piece including as said projection a rounded projection formed at an end of said elongated snap piece, and said rounded projection is engaged with a rounded recess as said recess formed at the side of the carriage.

17. The service station device according to claim 10, further comprised of an elastic force of said elastic member being smaller than a moving force of the carriage.

* * * * *